US007557343B2

(12) United States Patent
Hansen et al.

(10) Patent No.: US 7,557,343 B2
(45) **Date of Patent: *Jul. 7, 2009**

(54) SEGMENTED ROD MULTIPOLE AS ION PROCESSING CELL

(75) Inventors: Stuart C. Hansen, Palo Alto, CA (US); Gangqiang Li, Palo Alto, CA (US); Gavin E. Reid, Mason, MI (US)

(73) Assignee: Agilent Technologies, Inc., Santa Clara, CA (US)

( * ) Notice: Subject to any disclaimer, the term of this patent is extended or adjusted under 35 U.S.C. 154(b) by 633 days.

This patent is subject to a terminal disclaimer.

(21) Appl. No.: 11/224,093

(22) Filed: Sep. 13, 2005

(65) Prior Publication Data

US 2007/0057180 A1 Mar. 15, 2007

(51) Int. Cl.
*H01J 49/00* (2006.01)

(52) U.S. Cl. ..... 250/292; 250/281; 250/282; 250/283; 250/285; 250/287; 250/396 R

(58) Field of Classification Search ..... 250/281, 250/282, 283, 285, 287, 292, 396 R
See application file for complete search history.

(56) References Cited

U.S. PATENT DOCUMENTS

| | | | | |
|---|---|---|---|---|
| 5,847,386 | A * | 12/1998 | Thomson et al. | 250/288 |
| 6,833,544 | B1 | 12/2004 | Campbell et al. | |
| 7,312,442 | B2 * | 12/2007 | Hansen | 250/282 |
| 2002/0092980 | A1 * | 7/2002 | Park | 250/288 |

* cited by examiner

*Primary Examiner*—Jack I Berman
*Assistant Examiner*—Meenakshi S Sahu

(57) ABSTRACT

A method and apparatus for processing ions in mass spectrometry is provided. The apparatus includes an ion processing cell having segmented multipole rods and a means for admitting reactive reagent ions to the cell. Provision for timed sequence control of RF and DC voltages to the segmented multipole rods is included. Processing includes trapping analyte ions and subjecting them to selected reactions with reactive reagent ions and/or physical manipulation of the ions by changing the characteristics of the electric field and/or creating discrete regions in the field.

21 Claims, 3 Drawing Sheets

SEGMENTED ROD MULTIPOLE AS ION PROCESSING CELL

TECHNICAL FIELD

The technical field relates generally to ion analysis and more particularly to ion analysis in mass spectrometry.

BACKGROUND

Mass spectrometry methods are very useful for characterizing and/or quantifying chemical, biological and biochemical entities. Tandem mass spectrometry (MS/MS) methods have been shown to be particularly useful for characterizing individual components of a mixture and/or obtaining enhanced structural information from analytes that yield limited fragmentation.

In a typical MS/MS configuration, an ion of a specific mass to charge ratio (m/z) is selected in a first mass analyzer, and transferred to a collision cell where an inert gas is introduced to collide with the selected ion to generate fragmentation. The ions thus formed are then analyzed by a second mass analyzer to obtain a mass spectrum.

In U.S. Pat. No. 5,847,386, Thompson et al. suggest using tapered quadrupole rods to create an axial field in the collision cell of a quadrupole tandem mass spectrometer to facilitate movement of ions through a low energy system.

In U.S. Pat. No. 6,833,544, Campbell et al. disclose use of a linear ion trap component in a mass spectrometer system as a collision cell for collision induced dissociation. Campbell discloses use of segmented rods to form a gradient to move ions through a collision cell.

However, the need remains for improved apparatus and methods for processing ions in mass spectrometry.

SUMMARY

A segmented rod multipole apparatus is disclosed for processing ions in a mass spectrometry system. The apparatus comprises a set of elongated-segmented rods having ends and defining an elongated volume therebetween. The elongated volume has a longitudinal axis and each elongated-segmented rod has a plurality of segments. The apparatus further comprises a circuit for applying a Radio Frequency (RF) voltage to the elongated-segmented rods to provide an RF field in the volume, and a circuit for applying DC voltages to the segments. Different DC voltages can be applied to different segments to provide a DC field in the elongated volume wherein the DC field comprises a selectively controllable potential region or regions.

A method of processing ions also is disclosed. The method of processing ions comprises providing the segmented rod apparatus of the invention, providing analyte ions in the elongated volume; applying an RF field to the volume; applying a DC voltage selectively to the segments of the elongated segmented rods; providing analyte ions and reactive reagent in the elongated volume; and processing the analyte ions. Processing the analyte ions with reactive reagent in the elongated volume may comprise a reaction selected from the group consisting of ion-ion reactions, election transfer reactions, proton transfer reactions, electron induced dissociation, energy modulation of the analyte ions, alternating gradient fragmentation, collisional activation, photodissociation, ion-molecule reactions and combinations thereof.

Processed ions may be transferred to a mass analyzer for determination of a mass spectrum. Any mass analyser may be used, however the method is particularly well suited for use with a time-of-flight mass analyser.

DETAILED DESCRIPTION

Figure 1:
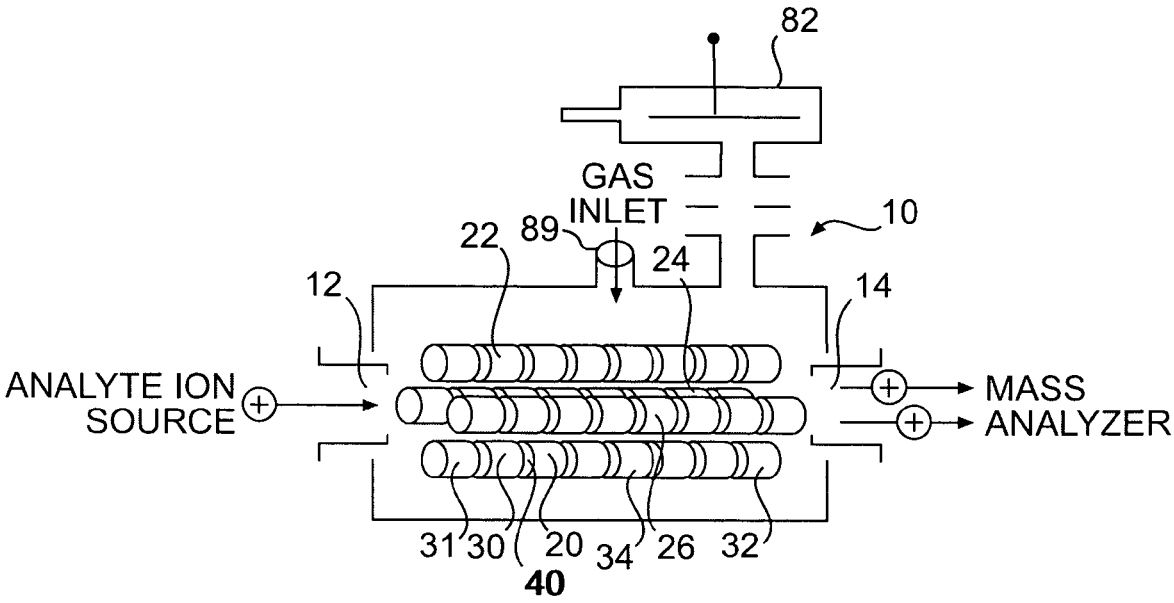
FIG. 1 is a perspective view of an ion processing cell.

The apparatus and method described herein provide for processing ions in mass spectrometry. More particularly the apparatus provides for trapping ions in an electric field in an ion processing cell, processing ions in the ion processing cell, and releasing the ions from the ion processing cell to a mass analyzer. Trapping may include trapping ions in a region of the electric field such as in a potential well. The ion processing cell comprises segmented quadrupole rods and a means for admitting a reactive reagent to the ion processing cell. The ion processing cell receives analyte ions from an analyte ion source and the reactive reagent from a reactive reagent source. The reactive reagent may include reactive reagent ions, reactive reagent molecules, an electron beam, a proton beam or a photon beam. The nature of the reactive reagent selected depends on the chemical nature of the analyte and the information sought in the analysis. Processing of the ions may include trapping and collecting analyte ions and/or subjecting the analyte ions to ion-ion proton transfer reactions, ion-molecule proton transfer reactions, ion-ion electron transfer reactions, ion-ion electron transfer dissociation, alternating gradient fragmentation, charge reduction, collisional activation, photodissociation (such as, for example, infrared multiphoton dissociation), ion-molecule reactions, ion-ion reactions, or a combination thereof. After processing, the processed ions may be transferred to any mass analyzer for determination of a mass spectrum. However, the apparatus is particularly well suited for use with time-of-flight mass analyzers.

Typically, the apparatus is used in a mass spectrometer system comprising an analyte ion source, an ion processing cell and a mass analyzer. Analyte ions are formed in the analyte ion source. For example, analyte ions may be generated in the analyte ion source by electron impact, chemical ionization, MALDI (Matrix Assisted Laser Desorption Ionization), electrospray, fast atom bombardment, and the like. The thus formed ions may be passed directly to the ion processing cell. Optionally, the system may further comprise a mass filter which transmits only selected ions of a specific mass to charge ratio (m/z) to the ion processing cell, and/or ions of a specific mass to charge ratio (m/z) may be selected in the processing cell prior to processing.

Analyte ions are admitted to the ion processing cell which comprises a set of segmented rods. The rods may be configured as a quadrupole, hexapole or other multipole structure. An RF voltage is applied to all rods to provide an RF field in an elongated region between the rods, and DC voltages are selectively and controllably applied to segments of the segmented rods, thus providing for the trapping of ions, control of movement of ions and controllable transfer of ions. Reactive reagent ions may be admitted to the ion processing cell and reacted with at least a portion of the analyte ions.

Optionally, processing may include manipulation of the DC and/or RF voltage in a timed sequence to modify the field or a portion of the field in the ion processing cell to provide conditions which may facilitate the reaction between the analyte and reactive reagent ions and/or provide for one or more additional processing steps. The term processed ion is used herein to refer to an ion that has been subjected to at least one processing step in the ion processing cell.

Ions admitted to the processing cell and trapped in the ion processing cell may be a sample (group) of ions having a mixture of m/z values or ions of a selected m/z value. Optionally, when a sample of ions having a mixture of m/z values is admitted to the ion processing cell, ions of a specific m/z value may be selected in the processing cell by ejecting ions having undesired m/z values from the processing cell. As discussed herein, processing ions in the ion processing cell includes ion-ion reactions, fragmenting ions, manipulation of physical properties of ions, selecting ions, isolating ions, and the like, and combinations thereof. After processing in the ion processing cell, the processed ions are transferred to a mass analyzer for analysis. Mass analyzers may include time-of-flight mass analyzers, quadrupole mass analyzers, momentum mass analyzers, ICR mass analyzers, and the like.

FIG. 1 shows a schematic perspective view of an exemplary embodiment of an ion processing cell 10 in which ions may be manipulated and/or reacted and/or fragmented. The ion cell 10 has an entrance orifice 12 and an exit orifice 14 for admitting ions to the ion processing cell 10 and transferring processed ions from the ion processing cell 10, respectively.

Figure 2:
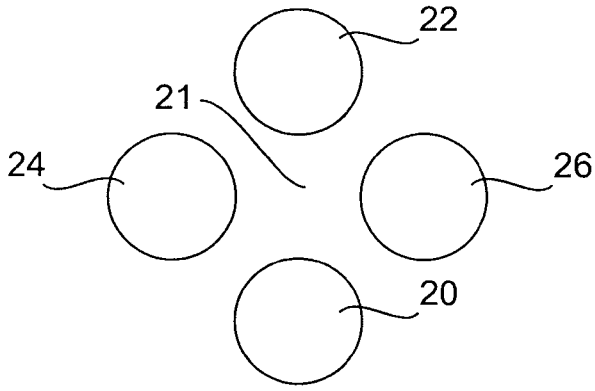
FIG. 2 is a cross sectional view of an ion processing cell.

As shown in FIG. 1, the exemplary ion processing cell 10 has four segmented quadrupole rods 20, 22, 24 and 26. As FIG. 1 and the cross sectional view of the ion processing cell 10 in FIG. 2 show, the segmented rods 20, 22, 24, 26 are housed in a vacuum chamber and positioned around an elongated trapping volume 21. Each segmented rod 20, 22, 24 and 26 is divided into a plurality of segments 30. Typically, all four segmented rods 20, 22, 24 and 26 are segmented in a similar manner. For example, one exemplary embodiment uses four rods, each 15 cm long by 12.5 mm in diameter and each divided into twelve similar segments. This example is exemplary and other sizes of rods 20, 22, 24, 26 and/or number of segments 30 may be similarly suitable. The segments 30 are separated by gaps 40. Segments 30 include a first end segment 31, a last end segment 32, and an intermediary segment 34. In an exemplary embodiment, the segments 30 are separated by gaps 40 of 0.3 mm in width. These dimensions are exemplary and other dimensions may be likewise suitable. The segments 30 may be discrete sections made of a conducting material or a substrate coated with a conducting material and aligned parallel to the segments of other rods using a support, such as, for example, an insulating ring (not shown).

In some embodiments, it is advantageous to use segmented rods 20, 22, 24, 28 in which the segments 30 are formed by coating a non-conducting rod with a conducting material at discrete positions interposed between uncoated areas of the non-conducting rod. For example, such a rod may be formed by applying a metalized layer onto a rod formed from an insulating material, such as a ceramic, for example, then removing portions of the metal coating. To remove portions of the metal coating a band may be cut in the metal around the circumference of the rod and the cut band of metal removed from around the circumference. Removal of the metal band forms a nonconducting gap 40. The process is repeated to form multiple gaps 40 interposed between remaining bands of metal. The bands of metal remaining on the rod form multiple segments 30. Segmented rods 20, 22, 24, 28 should be taken to mean either rods comprising discrete individual segments or a rods comprised of a nonconductive material selectively coated with a bands of conducting material to give regions of metal coated rod interposed between uncoated areas of nonconducting material, or a combination thereof.

A gas inlet 89 for admitting inert gas into the ion processing cell 10 and a reagent ion source 82 are also provided.

Figure 3:
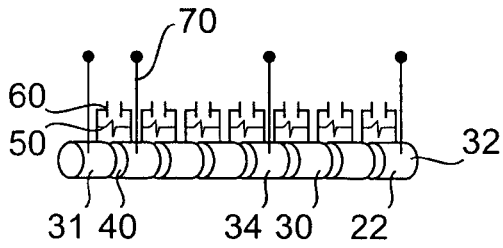
FIG. 3 is a schematic diagram of a segmented rod.

FIG. 3 shows an exemplary segmented rod 22. As shown in FIG. 3, each gap 40 is bridged by a chip resistor 50 and a capacitor 60 to provide a means for providing a constant RF voltage and optional DC gradient to form a potential field distribution in the elongated volume 21. The RF and DC voltages may be changed and manipulated in a timed sequence. A plurality of segments 30 have electrical leads 70 for controlling the DC voltage to the particular segment 30 connected to the lead 70. The leads 70 are for connection to driver electronics, which may be controlled manually or by an automated system. In one embodiment, the plurality of leads 70 include leads to a sufficient number of segments 30 to optionally create a trapping field inside the ion processing cell 10. For the exemplary rod 22 shown in FIG. 3, this would include leads 70 to end segments 31, 32 and an intermediary segment 34 of rod 22. The position of intermediary segment 34 shown in FIG. 3 is exemplary and any of the segments between end segments 31 and 32 may be selected as an intermediary segment. Typically end segments 31 and 32 are the terminal segments of the segmented rods, but segments near the terminus of the segmented rods may likewise serve as end segments 31 and 32. Leads 70 are connected similarly to the other segmented rods 20, 24, 26 of the apparatus including selecting the intermediary segment 34 to be in the same relative position on each segmented rod 20, 22, 24, 26. In some embodiments, it may be desirable to select the position of the intermediary segment to facilitate collecting ions in a specific physical region of the ion processing cell 10, such as, for example, near the position that the reactive reagent is added, or in a region where a photon beam is introduced.

In some embodiments, individual leads 70 may be attached to additional segments 30 or in other embodiments to all segments 30. The connection of a lead 70 to a specific segment 30 provides for direct control of the DC voltage and/or control of the DC potential field associated with the segment 30 so connected. Increasing the number of segments 30 attached to leads 70 provides for highly selective control of the field in elongated volume 21 including the ability to establish regions with different field conditions, such as for example potential wells, within the elongated volume 21.

As multiple leads 70 are used, the DC voltages can be manipulated to a group of segments 30 and/or individual segments 30 in a timed sequence. The DC voltages to segments 30 may be controlled and changed to create different configurations of the potential regions and/or a plurality of regions of differing field conditions in the elongated volume 21 (e.g., a number of regions and/or the nature of regions may be changed and/or field strengths to particular regions may be manipulated). The DC and RF circuitry provide for making such changes in a timed sequence. The timed sequence may involve changes in DC voltage and/or changes in RF voltages. Thus, ions can be trapped in the elongated volume 21 and/or in a portion of the elongated volume 21 and subjected to a sequence of potential field conditions.

Figure 4:
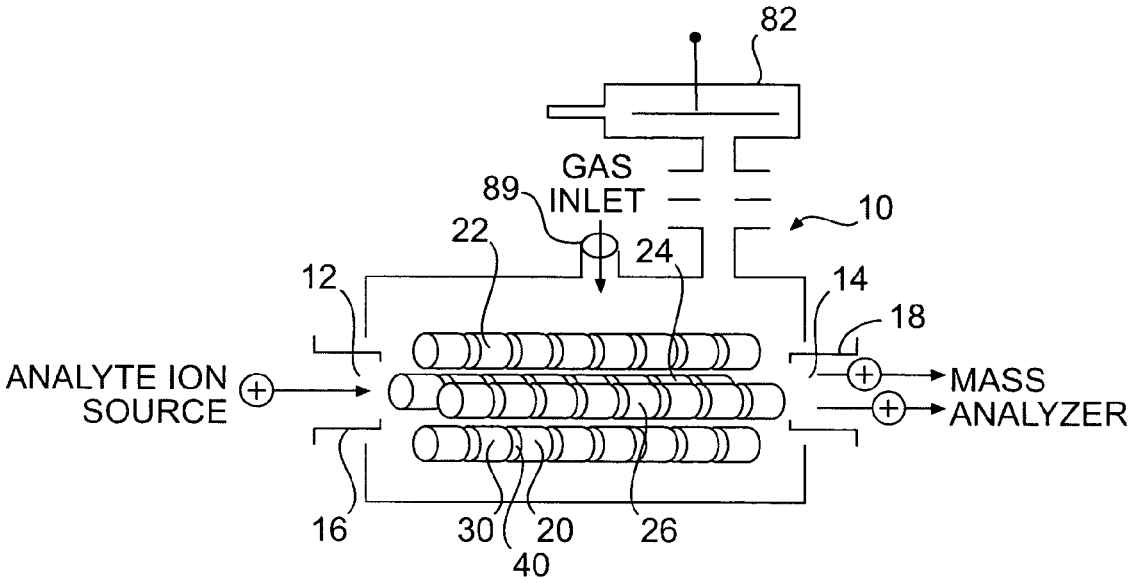
FIG. 4 is a perspective view of an ion processing cell.

As shown in FIG. 4, the ion processing cell may further include shield electrodes 16 and 18. In FIG. 4, the shield electrodes 16 and 18 are shown in a cutaway view. Each shield electrode 16 and 18 is a cylindrical sheath with an entrance and an exit opening aligned with the elongated axis of the trapping volume 21. The shield electrodes 16, 18 may serve a shielding function and/or, as described below, serve as an ion gate to facilitate trapping and storing ions in the ion processing cell 10.

Figure 5:
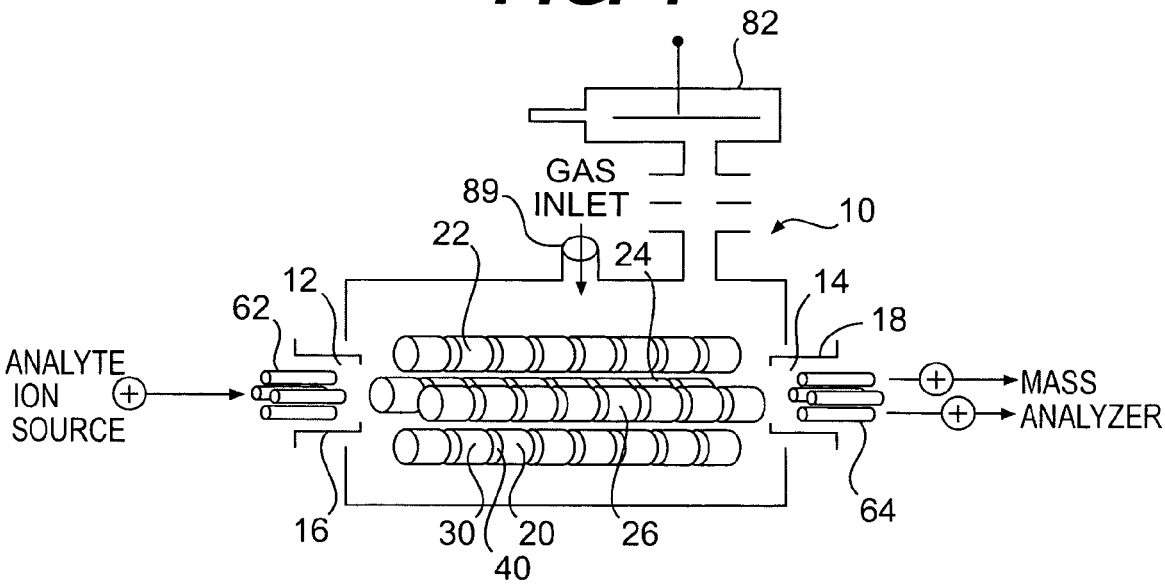
FIG. 5 is a perspective view of an ion processing cell.

As shown in FIG. 5, the ion processing cell 10 may further include a pair of ion guide multipoles 62, 64. The ion guide multipoles 62, 64 may serve to guide ions into the ion processing cell 10. The voltage applied to ion guide multipoles 62, 64 may be RF only, or DC and RF. Optionally, in some embodiments, the DC potential of the ion guide multipoles 62, 64 may be selectively changed to admit analyte ions to the ion processing cell 10, trap analyte ions in the ion processing cell 10, and release ions from the ion processing cell 10.

The ion processing cell 10 provides many experimental options for processing ions. The options for processing ions described herein are exemplary of the many kinds of analyses the ion processing cell 10 facilitates.

Time-of-flight mass analyzers typically receive pulses of ions for analysis, with a considerable portion of the ions generated in an analyte ion source between pulses not captured in packets for analysis. In one exemplary embodiment, interposing the ion processing cell 10 between an analyte ion source and a time-of-flight mass analyzer provides for collecting ions generated between pulses and storing ions for release into the mass analyzer in the next pulse. Collection and storage permits analysis of a larger portion of analyte ions in the time-of-flight system (e.g., by increasing the duty cycle of the time-of-flight analyzer). In some embodiments, it may be possible to collect, store and analyze most of the ions formed in the analyte ion source.

Referring to FIG. 1, collection and storage of ions produced in the analyte ion source may be accomplished in an exemplary embodiment by adjusting the potential of the first end segments 31 of each rod to admit ions from the analyte ion source and the potential on the last end segment 32 of each rod to prohibit exit of ions to the time-of-flight mass analyzer. In one embodiment, to trap ions, the voltage of at least one selected intermediary segment 34 of each rod is adjusted to a potential lower than the potential of first end segments 31 and last end segments 32. Once ions are collected, the potential of the first end segments 3 1 is raised to prohibit ions from entering or exiting the entrance orifice 12. The voltage to the intermediary segments 34 may remain the same or be variously adjusted as the ions are processed. To send a pulse of ions to the time-of-flight mass analyzer, the voltage of the last end segments 32 is lowered at the exit orifice 14, thus permitting transfer of a packet of ions into the time-of-flight mass analyzer. It may also be desirable to adjust the potential of the intermediary segments 34 to provide a gradient that facilitates transfer of ions.

Typically, ions are collected in the presence of an inert gas to slow the ions. The gas may be admitted to the ion processing cell 10 through gas inlet 89. The gas pressure should be sufficient to slow the ions but not so high as to induce fragmentation of the ions. Gas pressures of 1 to 20 mTorr are typically sufficient. The optimum pressure depends on the ions to be analyzed and the type of inert gas used. For many applications, a pressure of 5 to 10 mTorr is used and use of a pressure of about 5 mTorr is common. Suitable inert gases include argon, krypton, and nitrogen, for example.

Alternatively, ions produced in the analyte source may be collected and stored in the ion processing cell 10 using ion gates near the entrance orifice 12 and the exit orifice 14. The gates may be the shield electrodes 16, 18 shown in FIG. 4 or multipole ion guides 62, 64 shown in FIG. 5, for example. Referring to FIG. 4, the collection and storage of ions may be accomplished by adjusting the potential of the shield electrodes 16, 18. To trap ions, the potential of shield electrode 16 near entrance orifice 12 is lowered to admit ions and the potential of shield electrode 18 near exit orifice 14 is raised to prevent ions from leaving the ion processing cell 10. Once a group of ions is collected, the potential of the shield electrode 16 is raised and the group of ions is trapped. To release the ion processed ions from the processing cell 10, the potential of the shield electrode 18 at the exit orifice 14 is lowered to permit transfer of a packet of ions to the time-of-flight mass analyzer. In some embodiments, it may be desirable to adjust the voltage of one or more sets of intermediary segments 34 to establish a gradient to facilitate the transfer. A set of intermediary segments 34 should be taken to be one segment from each of the segmented rods wherein each of the intermediary segments 34 is located in a similar position on each rod. Thus, a set of intermediary segments 34 surround a portion of the elongated volume 21.

Referring to FIG. 5, collection and storage of analyte ions produced in the analyte source may be accomplished by manipulation of the voltages to the ion guide multipoles 62, 64. During the collection phase, the DC potential is lowered for the ion guide multipole 62 positioned near the entrance orifice 12 and the DC potential of ion guide multipole 64 near the exit orifice 14 is adjusted to a potential that prohibits exit of ions to the time-of-flight mass analyzer. To trap ions, the potential of the ion guide multipole 62 near the entrance orifice 12 is raised to prevent ions from entering or exiting the entrance orifice 12. To send a pulse of ions to the time-of-flight mass analyzer, the voltage to the ion guide multipoles 64 near the exit orifice 14 is adjusted to lower the potential of the field at the exit orifice 14 and permit transfer of a packet of ions into the time-of-flight mass analyzer. It may be desirable to adjust the voltage of one or more sets of intermediary segments 34 to facilitate transfer.

The end and intermediary segments 31, 32, 34; the shields 16, 18; and the ion guide multipoles 62, 64 may perform functions other than acting as ion gates in some embodiments and these structures are not necessarily employed as ion gates when present in a specific embodiment. The segments 31, 32, 34, the shield electrodes 16, 18, or the ion guide multipoles 62, 64, or some combination thereof, may be used as ion gates in a specific embodiment.

Ions collected in the ion processing cell 10 may be simply collected and transferred to the mass analyzer as a group (e.g. packet). As discussed above, such a process can enhance the duty cycle of a time-of-flight mass analyzer. The enhancing of the duty cycle typically increases sensitivity. Alternatively, ions may be collected and reacted and/or otherwise manipulated in the ion processing cell 10 prior to transfer to the mass analyzer.

Figure 6:
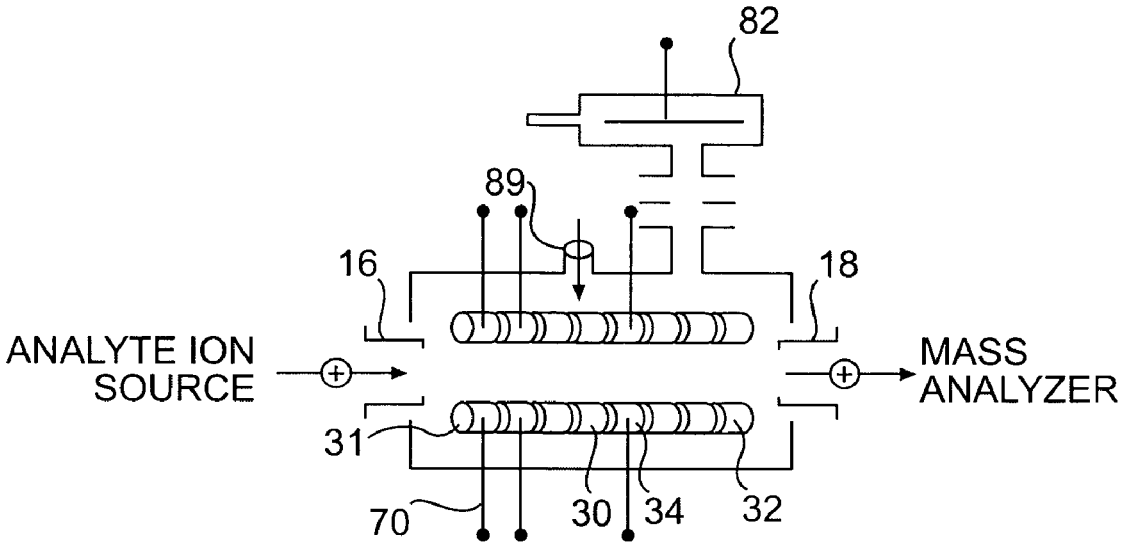
FIG. 6 is a schematic diagram of an embodiment of an ion processing cell.

For example, referring to FIG. 6, ions collected in the ion processing cell 10 may be reacted with reactive reagent admitted into the ion processing cell 10 from the reactive reagent source 82 through reactive reagent orifice 80. It may be desirable in some embodiments to select the position of a set or sets of intermediary segments 34 to facilitate collection of analyte ions near reactive reagent orifice 80. Collection of analyte ions near the reactive reagent orifice 80 may optimize the opportunity for analyte and reactive regent ions to react. Further in some embodiments a lense or lenses 81 may be provided to focus and/or position the reactive reagent near the analyte ions which facilitate optimizing interaction between the reactive reagent and analyte ions.

Reactive reagent ions may be ions derived from molecules and atoms or alternatively charged entities such as electrons or protons. In the examples described herein, the reactive reagent ions are typically described as derived from molecules and atoms. However, it should be understood that electrons or protons derived from sources such as filaments or radioactive sources, for example, may be reacted with analyte ions to yield similar results in some applications, and accordingly are included within the scope of reactive reagent ions. The reactive reagent ions react with the collected analyte ions. The nature of the analyte ions and the nature of the reactive reagent ions will determine the particular type of reaction that may occur. Accordingly, the ion processing cell 10 has both the advantage of being applicable to a very wide range of species of ions and the advantage, if desired, of being very specialized in the type of ion-ion reaction by careful selection of reactive reagent ions. The reactive reagent ions may react chemically with the analyte ions thereby changing the chemical structure of the analyte ions. The change of structure may include forming adducts and/or interacting to form one or more chemical species that are different from the reactive reagent ions and the analyte ions. The products of the chemical reactions, when analyzed, provide a mass spectrum or other data that facilitates characterization of the analyte ions. The characterization may include structure information and/or information about the physical and/or chemical attributes of the analyte ions and/or provide a species that facilitates quantification.

The ion processing cell 10 may be employed for the analysis of either positive or negative analyte ions. Optionally, circuitry can be provided which permits for changing polarity, including changing the polarity of the ion processing cell 10 and reactive reagent source 82 to accommodate both types of analysis using a single processing cell 10.

Addition of reactive reagent ions radially, as shown in the diagram of FIG. 6, typically results in a region of the elongated volume 21 having a higher density of reactive reagent ions. (Note: FIG. 6 shows only rods 20, 22. For the quadrupole example, rods 24, 26 are omitted from the diagram for simplicity of illustration. In practice the ion processing cell 10 comprises a multipole and, accordingly, quadrupoles would have four segmented rods as shown in FIGS. 1, 2, 4 and 5; hexapoles would have 6 segmented rods; and other multipoles would have the customary number of rods for the identified multipole.) Ion density may be further enhanced in some embodiments by utilizing a set of intermediary segments 34 to form a gradient to facilitate collection of analyte ions in a regions of the elongated volume 21 near the reactive reagent orifice 80. Higher ion density is advantageous in some embodiments to facilitate reaction. The feature of enhancing ion density in a given region is particularly useful in a linear ion trap. In the linear ion trap, which typically has a larger trapping volume than a 3-D ion trap, the ability to form regions of high ion density within the linear ion trap facilitates reactions of analyte ions with reagent ions. Ion density in a particular region of the ion processing cell 10 can be further adjusted by applying a gradient potential to all the segmented rods or to a selected portion of the segmented rods. Adjustment of potential to selected segments 30 of the rods is accomplished through the segment leads 70.

Figure 7:
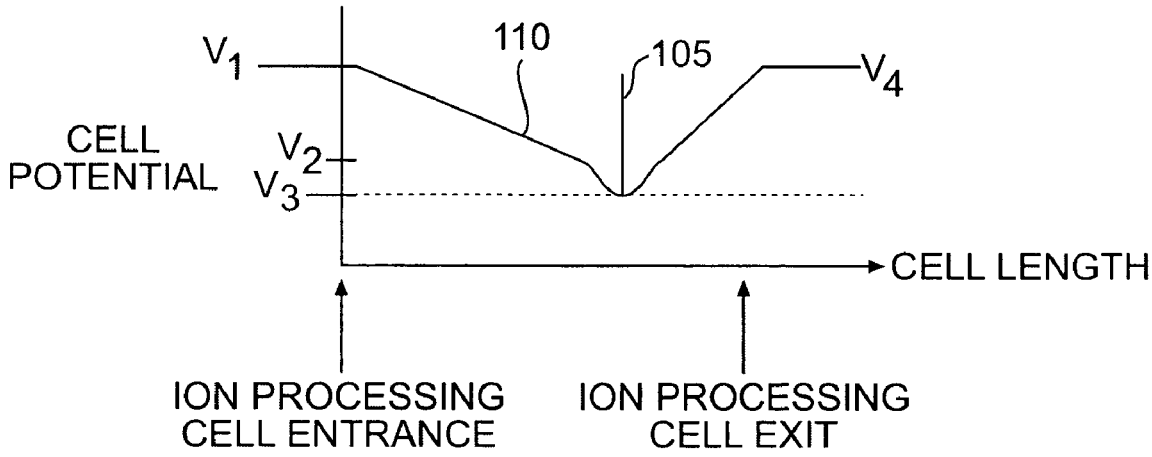
FIG. 7 is a diagram of an exemplary potential diagram for an ion processing cell.

FIG. 7 shows a potential diagram for an exemplary utilization of the exemplary embodiment of FIG. 6. As illustrated in FIG. 7, the potential diagram voltages may be selected to create a potential well 105, which provides a discrete region for trapping ions and facilitating ion-ion reaction. FIG. 7 also shows applying a voltage gradient 110 to facilitate directing ions to the potential well 105. The DC and RF circuitry permits selective, controllable adjustment of the voltages in a timed sequence to create, move or eliminate the gradient 110, or potential well 105, for example. Accordingly, variables such as presence of the gradient 110, presence of the potential well 105, position of the gradient 110, position of the potential well 105, energy associated with the potential well 105, energy associated with a gradient 110, and the like, are adjustable and changeable during the course of an analysis (e.g., while using the ion processing cell 10 to process ions). This controllable selectivity provides flexibility for optimizing the conditions for ion-ion reactions by facilitating positioning of the analyte ions and/or adjusting the energy of the ions during processing, for example. Optionally, these changes can be made in a predetermined timed sequence. The predetermined timed sequence may be automated if desired.

As shown in the potential diagram of FIG. 7, in a particular time period during ion processing, a voltage $V_2$ is applied to a plurality of the segments 30 while higher voltages $V_1$ and $V_4$ are applied to segments 31 and 32, respectively. The voltage combination forms a trap that collects analyte ions and/or reactive reagent ions in the processing cell 10. At the same time a voltage $V_3$, which is lower than $V_2$, may be applied to intermediary segments 34. Application of the lower voltage $V_2$ forms a potential well 105 in the ion trapping region. Ions move into the area of lower potential, e.g., the well 105, and form an ion cloud having an enhanced density of ions. Confinement of the analyte ions in the cell facilitates reaction of analyte ions with reactive reagent and collection of analyte ions in a potential well 105 further facilitates efficient analyte ion and reactive reagent interaction and reaction. Trapping of ions in the ion processing cell may be further facilitated by virtue of non-fragmenting energy absorbing collisions of the ions with an inert gas in the cell. The inert gas may admitted to the cell via gas inlet 89.

The diagram of FIG. 7 is only one example of the many combinations of potential distributions that may be established in the ion processing cell 10. Further, the potential distributions are readily changeable, in a timed sequence. As ions are trapped in the ion processing cell 10, not only may the sequences be timed, but also the time allotted to a sequence or any portion of a sequence is flexible as there is no fixed residence time in the ion processing cell 10. Accordingly, the ion processing cell 10 provides the flexibility to optimize time of reaction as compared to devices which have fixed residence times, for example.

In some embodiments, the analyte ions and reactive reagent ions undergo charge transfer or charge exchange reactions. Charge transfer reactions have many applications. Exemplary applications include charge reduction and/or dissociation. Charge reduction and dissociation applications may be useful in the analysis of many kinds of molecules, particularly analysis of large molecules such as proteins.

For example, a large molecule such as a protein typically bears a number of positive charges when the protein is released from a conventional electrospray or Atmospheric Pressure Chemical Ionization (APCI) analyte ion source into a mass analyzer. Because m/z or mass to charge ratio is the detected entity, an ion specie having multiple charges would yield a series of ions related to the molecular ion specie. For example, an ion with up to four charges and a neutral mass m of 1000 would yield a mass spectrum showing ions of 1001 ((m+1)/1), 501((m+2)/2), 334.3((m+3)/3), and 251((m+4)/4) all related directly to the m/z of the molecular ion species of the analyte ion. In a time-of-flight mass analyser, a plurality of ions generated due to a plurality of charge states can lead to confusion in distinguishing the spectral contribution from the various charge states from the spectral contributions of other components and/or fragments. However, if the multiple-positively charged ion is exposed to a suitable reactive reagent ion of opposite polarity, proton or electron transfer may occur, which reduces the number of charges on the multiply charged ions. For a multiple-positively charged species such as a protein or peptide, protons are transferred from the multiple-positively charged ions to negatively charged reactive reagent ions in charge transfer reactions. The number of positive charges may, in some embodiments, be reduced to one positive charge on the analyte ion and/or fragments from the analyte ion which is particularly desirable. However, partial reduction of charge may be beneficial in some applications as it provides some potential simplification of spectra. Although in conventional analysis it is more common for the analyte ions to have a multiplicity of positive charges, a negativity charged analyte that transfers protons from a positively charged reactive reagent ion is likewise possible.

In another application, electrons can be transferred from the reactive reagent ions to analyte ions in the ion processing cell 10. This transfer of the electrons to positively charged analyte ions can result in charge reduction and/or induce electron transfer dissociation of the analyte ions. For example, use of reactive reagent ions such as fluoranthene provides suitable electrons that can induce fragmentation of a multiple-positively charged peptide ion following electron transfer. Such election transfer dissociations are particularly useful in characterizing peptides and proteins. Typically, such collisions yield at least some fragmentation different than that of conventional collisional activation with an inert gas. For example, in the case of proteins, the fragmentation resulting from election transfer dissociation is particularly useful for obtaining certain key sequence information by identifying c and z ion sequences, for example, and/or characterizing post-translational modifications.

The ability to selectively create regions of different potentials and change the potential permits, not only trapping of ions for processing with reactive reagent ions and transferring them from the ion processing cell to a mass analyzer, but also provides for optionally trapping ions in a specific region within the elongated volume 21 and modulating the energy of ions. For example, moving the trapped ions in an alternating gradient in the ion processing cell can increase the ion energy. An alternating gradient may be produced by providing a field gradient along the segments of the rods and reversing the field gradient in a timed sequence. Exposing ions to the alternating gradient increases ion energy and/or enhances fragmentation generally and/or certain types of fragmentation.

Ions may undergo a single processing step in the ion processing cell 10 or multiple processing steps. The multiple processing steps may comprise repetition of the same type of processing step, one or more different processing steps or a combination thereof. Selection of the processing step or steps to use is determined by the information sought, and the chemical and physical properties of the analyte ions and reactive reagent. Optimization of the experimental design and parameters is typically determined experimentally.

Multiple step processing may include collisional activation of product or fragment ions formed in a previous processing step. To perform collisional activation, ions of the m/z of interest are selected and ions having other m/z values are radially ejected from the elongated volume 21 in the ion processing cell 10. Radial ejection may be done as described by Flory et. al. in U.S. Pat. No. 5,672,870.

Collisional activation is then performed by using an inert gas in the ion processing cell 10 containing the selected ions. The selected ions in the processing cell 10 collide with the inert gas and may undergo collision induced fragmentations (e.g., collisional activation.) Typically an inert gas such as argon or krypton or the like is used as the collision gas. A gas pressure of about 5 m Torr and a collision energy of 20-40 eV is exemplary of typical parameter for collisional activation in the ion processing cell 10. These parameters are exemplary and other parameters may be likewise suitable. The collision gas may be admitted through the reactive reagent ion orifice 80 or via a separate orifice radially positioned.

Upon completion of the collisional activation, the collected ions and fragments may be transferred to the mass analyzer to obtain the mass spectrum or subjected to a further processing step or steps before transfer from the ion processing cell 10 to the mass analyzer to obtain the mass spectrum. Further processing may include selection of specific ions and reaction of the selected ions with reactive reagent ions and/or an additional step or steps of collisional activation (e.g., $MS^n$) of the selected ions, and/or manipulation of the selected ions by modifying the field, and the like, or a combination thereof. The transfer of processed ions to the mass analyzer is accomplished as discussed above by changing the potential of the ion gate 18 at the exit orifice 14. A mass spectrum may be obtained by analysis in the mass analyzer.

The foregoing discussion discloses and describes many exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

The invention claimed is:

1. A segmented rod multipole apparatus for processing ions comprising:

a set of elongated-segmented rods defining an elongated volume therebetween, wherein each elongated-segmented rod has a plurality of segments;

a circuit for applying a RF voltage to the elongated-segmented rods to provide an RF field in the volume;

a circuit for applying a DC voltage to the segments, wherein different DC voltages can be applied to different segments to form a DC field, and wherein the DC field in the elongated volume comprises a selectively controllable potential region; and a reactive reagent source, wherein the reactive reagent source is in communication with the elongated volume.

2. The apparatus of claim 1, wherein a first end segment of each elongated-segmented rod, a last end segment of each elongated segmented rod, and an intermediary segment of each elongated segmented rod are operable to form an ion trap.

3. The apparatus of claim 1, wherein the different voltages applied to the different segments form a voltage gradient, and wherein the different voltages are adjustable to form a controllable, reversible potential gradient.

4. The apparatus of claim 1, wherein the RF and the DC voltages are applied and changed selectively in a predetermined timed sequence.

5. The apparatus of claim 1, further comprising:

an analyte ion source for injecting ions into the elongated volume; and mass analyzer for receiving ions from the elongated volume, wherein the analyte ion source and mass analyzer are in communication with the elongated volume.

6. The apparatus of claim 5, wherein the analyte ion source includes an ion generation portion and a mass filter portion, wherein the mass filter portion transmits ions of a selected mass to charge ratio, and wherein the analyzer is a time-of-flight analyzer.

7. A segmented rod multipole apparatus for processing ions comprising:

a set of elongated-segmented rods having ends and defining an elongated volume therebetween, each elongated-segmented rod has a plurality of segments;

a circuit for applying a RF voltage to the elongated-segmented rods to provide an RF field in the volume;

a circuit for applying a DC voltage to the segments, wherein different DC voltages can be applied to different segments to form a DC field, and wherein the DC field in the elongated volume comprises a selectively controllable potential region;

a first and a second ion gate adjacent the elongated volume; and a reactive reagent ion source, wherein the reactive reagent ion source is in communication with the elongated volume.

8. The apparatus of claim 7, wherein the first and second ion gate comprises a first and a second ion guide multipole.

9. The apparatus of claim 7, wherein the first and second ion gate comprises a first and a second shield electrode.

10. The apparatus of claim 7, wherein the RF and the DC voltages are applied and changed selectively in a predetermined timed sequence.

11. The apparatus of claim 7, further comprising:

an analyte ion source for injecting ions into the elongated volume; and mass analyzer for receiving ions from the elongated volume, wherein the analyte ion source and mass analyzer are in communication with the elongated volume.

12. A method of processing ions comprising:

providing a set of elongated-segmented rods having ends and defining an elongated volume therebetween, each elongated-segmented rod has a plurality of segments;

applying a RF voltage to the elongated-segmented rods to provide an RF field in the elongated volume;

applying a DC voltage to the segments, wherein different DC voltages can be applied to different segments and the DC voltage to a given segment can be selectively changed in a timed sequence;

providing analyte ions in the elongated volume;

applying an RF field to the volume;

applying a DC voltage to at least a portion of the segments of the elongated segmented rods;

providing a reactive reagent in the elongated volume; and processing the analyte and reactive reagent in the elongated volume.

13. The method of claim 12, wherein processing the analyte and reactive reagent comprises a reaction selected from the group consisting of ion-ion reactions, electron transfer reactions, proton transfer reactions, electron induced dissociation, energy modulation, alternating gradient fragmentation, collisional activation, photodissociation, ion-molecule reactions, or a combination thereof.

14. The method of claim 12, wherein the RF and the DC voltages are changed in a timed sequence.

15. The method of claim 12 wherein the reactive reagent ions are substantially contained in a portion of the elongated volume for a defined time.

16. The method of claim 12, further comprising:

selecting processed ions of a specific mass to charge ratio in the elongated volume;

retaining the selected processed ions in the elongated volume for a pre-determined period of time; and ejecting processed ions having a mass to change ratio different from the selected ions from the elongated volume.

17. The method of claim 16, further comprising processing the selected processed ions by adding a reagent selected from the group consisting of reactive reagent ions and inert gases to the elongated volume.

18. The method of claim 16, further comprising processing the selected product ions by manipulating the DC voltage.

19. The method of claim 12, further comprising transferring at least portion of the processed ions to a mass analyzer and obtaining a mass spectrum of the ions.

20. The method of claim 12, wherein processing the analyte ions and reactive reagent ions comprises electron induced dissociation.

21. A segmented rod multipole apparatus for processing ions comprising:

a set of elongated-segmented rods defining an elongated volume therebetween, wherein the volume has a longitudinal axis and each elongated-segmented rod has a plurality of segments;

a circuit for applying a RF voltage to the elongated-segmented rods to provide an RF field in the volume;

a circuit for applying a DC voltage to the segments, wherein the circuit for applying a DC voltage has a plurality of leads, each lead connected to an individual segment of the elongated segmented rods and wherein voltage to a first individual segment connected to a first lead can be controlled independently from a voltage to a second individual segment connected to a second lead;

a reactive reagent source, wherein the reactive reagent source is in communication with the elongated volume.

* * * * *